US005214709A

United States Patent [19]

Ribic

[11] Patent Number: 5,214,709

[45] Date of Patent: May 25, 1993

[54] HEARING AID FOR PERSONS WITH AN IMPAIRED HEARING FACULTY

[75] Inventor: Zlatan Ribic, Vienna, Austria

[73] Assignee: Viennatone Gesellschaft m.b.H., Vienna, Austria

[21] Appl. No.: 723,929

[22] Filed: Jul. 1, 1991

[30] Foreign Application Priority Data

Jul. 13, 1990 [AT] Austria ..... 1500/90

[51] Int. Cl.[5] ..... H04R 25/00

[52] U.S. Cl. ..... 381/68.1; 381/92; 381/113; 367/126

[58] Field of Search ..... 381/68.1, 168, 92, 113, 381/170; 367/126, 125, 123

[56] References Cited

U.S. PATENT DOCUMENTS 2,678,967 5/1954 Grosskopf ..... 381/113
4,354,059 10/1982 Ishigaki et al. ..... 381/92
4,757,545 7/1988 Rosander ..... 381/113
5,029,215 7/1991 Miller, II ..... 381/92

FOREIGN PATENT DOCUMENTS 0219894 11/1985 Japan ..... 381/92
0189898 8/1987 Japan ..... 381/92
1604167 12/1981 United Kingdom ..... 381/170

*Primary Examiner*—Jin F. Ng
*Assistant Examiner*—Huyen D. Le
*Attorney, Agent, or Firm*—Collard & Roe

[57] ABSTRACT

Hearing aid for persons with an impaired hearing faculty, including a directional microphone whose pick-up characteristic can be altered, the pick-up characteristic being automatically controlled as a function of the input or output signal in such a way that all possible microphone characteristics may be set, and this is realized in that the directional microphone (10) is an electret microphone and that the changes in the pick-up characteristic take place electrically and continuously.

7 Claims, 2 Drawing Sheets

HEARING AID FOR PERSONS WITH AN IMPAIRED HEARING FACULTY

Figure 1A:
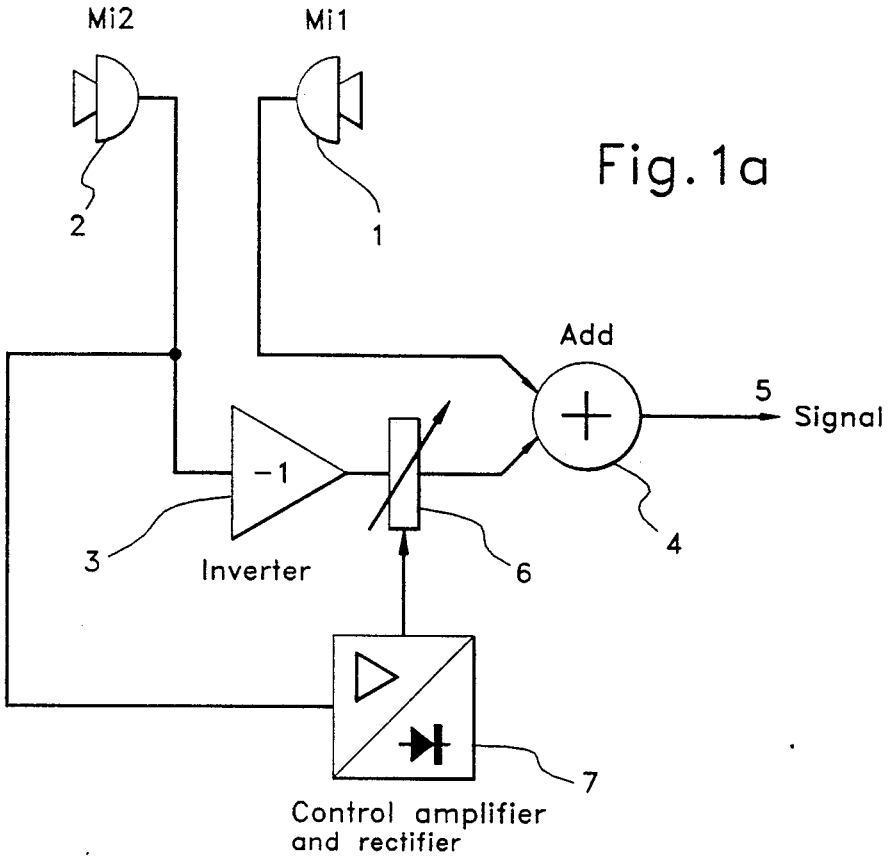

The invention relates to a hearing aid for persons with an impaired hearing faculty, said hearing aid comprising a directional microphone whose pick-up characteristic can be changed.

Practically all current hearing aids are provided with one of either two possible types of microphones.

One type is the so-called pressure microphone that transforms air pressure into electrical voltage, the other is the so-called pressure gradient microphone, whereby the air pressure gradient serves as the reference value.

As the air pressure in one point is not a vector, but a scalar quantity, the pressure microphone picks up the sound independent of the direction of incidence as long as its dimension are small relative to the wavelength. The pressure microphone therefore has a so-called omnidirectional characteristic.

In contrast to this, the pressure gradient microphone picks up the sound at two points, whereby the difference in pressure is picked up at these two points. It is quite typical for this sort of microphones that, when regarded in a plane, the pick-up characteristic resembles the digit 8. This type of pick-up characteristic is therefore also called "bidirectional characteristic". Due to the fact that the pressure gradient depends on the frequency, pressure gradient microphones tend to transmit low frequencies less strongly than high frequencies, that is to say with a slope of +6 dB/octave. It is possible and well known to build in attenuating and delay elements in one of the two sound inputs, thus enabling intermediate stages ranging from bidirectional characterstics to near omnidirectional characteristics (e.g. cardioid characteristic). If the sound input opening of a pressure gradient microphone is closed completely, it acts like a normal pressure microphone with an omnidirectional characteristic.

As a rule, present hearing aids are equipped with either a normal pressure microphone or a directional microphone (pressure gradient microphone). Directional microphones are ideal for a noisy environment, but one must, however, accept the disadvantages of bass suppression and audible noise background in a quiet environment. Pressure microphones show good results in a quiet environment, but not in a noisy one. It has therefore been tried to compensate these disadvantages by combining both types of microphones.

A hearing aid is known that comprises a kind of mechanical valve for manually closing the sound input opening. Apart from constructional problems concerning this type of switching the pick-up characteristic, the person with the impaired hearing faculty often has difficulties in recognizing which characteristic would be the best in a given situation.

It is the object of the present invention to create a hearing aid that avoids the disadvantages of common hearing aids as was mentioned above, whereby the pick-up characteristic is automatically controlled as a function of the input or output signal in such a manner that all possible characteristics may be set between bidirectional and omnidirectional.

In accordance with the invention this task is fulfilled in the hearing aid of the type as mentioned above in that the directional microphone is an electret microphone and that the change in the pick-up characteristic takes place electrically and continuously.

This leads to the advantage that in a noisy environment low frequencies are suppressed, and that the microphone comprises a bidirectional characteristic (e.g. cardioid). In a quiet environment, however, the microphone becomes a pressure capsule, i.e. it is linear and comprises an omnidirectional characteristic.

In accordance with a further feature of the invention it is provided that the directional microphone is formed by two pressure systems whose sound input openings are to be found separated apart, whereby the output voltage of the one microphone is inverted and added to the output voltage of the other microphone via an attenuator, and that in this manner &he function of a pressure gradient microphone is simulated.

In the event of loud signals the low-frequency suppression seems like an ASP ("Automatic Signal Processing") and thus improves speech recognition. In addition, the pick-up characteristic suppresses distortive sound from undesirable sources. In a quiet environment the reproduction is given a large amount of bass and is thus pleasant to hear. The microphone then picks up sound from all directions.

In accordance with a further feature of the invention it is provided that the controllable attenuator is manually adjustable. This allows the user to influence the device.

In accordance with the invention it is further provided that the controllable attenuator is arranged as a current- or voltage-controlled attenuator whose controller output is the input or output signal of the hearing aid, and that the two individual microphones are replaced by a double membrane system in one casing.

A common pressure capsule comprises a membrane that is connected with the surrounding air on its one side and with a closed chamber on its other side. Therefore, the deflection of the membrane only depends on the momentary pressure exerted by the surrounding air. A pressure gradient capsule, on the other hand, only consists of a membrane connected on both sides with the surrounding air and must therefore be regarded as a system with two inputs. Each side of the membrane is equivalent to an input, whereby the membrane deflection is controlled by the difference in pressure between the two inputs.

A gradient effect can be artificially achieved by using two pressure capsules. When the two pressure capsules are spaced apart, they pick up the pressure at two points, i.e. at the position where the inputs of the capsules are located. The two electric signals provide an image of the two pressure values.

Figure 1B:
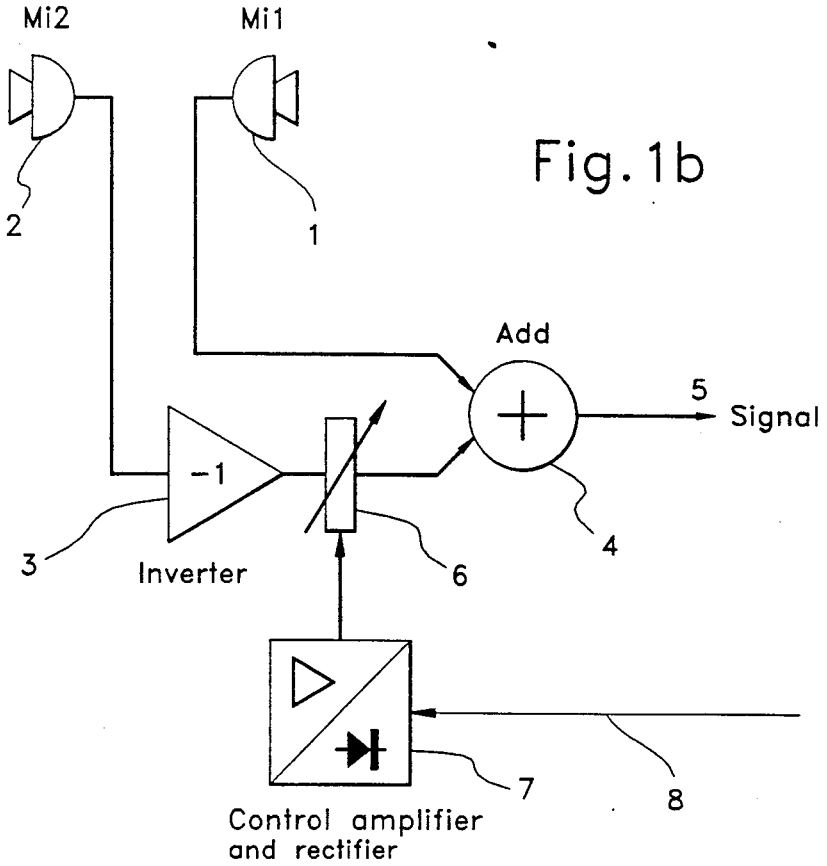

The invention is now outlined in closer detail by way of a preferred embodiment by reference to the enclosed drawings, in which:

FIGS. 1*a* and 1*b* show a circuit diagram of the hearing aid in accordance with the invention.

Figure 2:
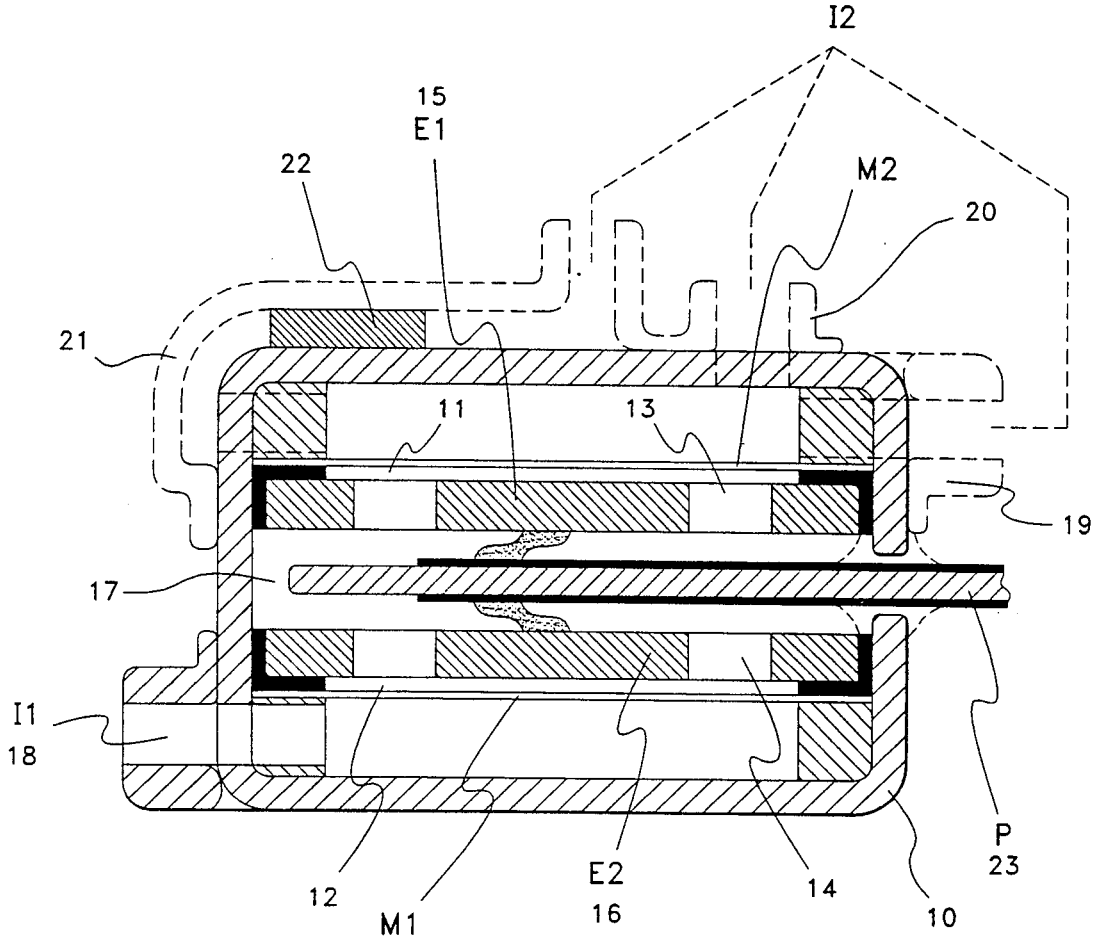

FIG. 2 shows a sectional view providing the arrangement of another preferred embodiment of the invention.

FIG. 1*a* and 1*b* show an arrangement with two pressure capsules Mil 1 and Mi2 2. With the help of the inverter 3 it is possible to invert the phase of a signal and to add both signals in a summing amplifier 4. By means of this process only the difference between the two signals is transmitted to output 5 of the circuit. Thus a typical gradient effect is achieved. If the microphone signal of Mi2 is continuously attenuated by means of attenuator 6, the transmission towards Mil changes, i.e. towards an omnidirectional characteristic. Attenuator 6 may, for example, be a voltage-controlled attenuator (VCA) that receives its control signal directly from one of the two microphones via a variable-gain amplifier and rectifier 7 ("input controlled") as shown in FIG. 1*a* from the the output 8 (output stage) of the hearing aid ("output controlled") as shown in FIG. 1*b*.

Because of lack of space and high costs it is not very advisable to build two mechanically separated microphones into a hearing aid.

A more elegant solution is the two-membrane system in accordance with the invention, as is schematically displayed in FIG. 2. In principle, two pressure capsules connected to one another in a casing 10 are arranged, said capsules having separate inputs and outputs. The rear volumes 11, 12 are connected to one another via holes 13, 14 in the counter electrodes E1 and E2 15, 16 and an acoustic resistor 17 provided between said volumes. Il is the sound input opening 18 of the main system Ml (directed forward). The sound input opening 12 of the second system may be arranged on the opposite slim side 19 and may consist of a hole in the lid with a nozzle 20 or, for a deflector 21 whose interior may, for include an element 22 for attenuating and/or delaying the sound, for example. "P" is a substrate 23 that is provided for contact purposes on the outer side and that may comprise a FET amplifier for both systems.

Said capsule has the same properties as the system mentioned above that comprises two pressure capsules. The advantage of this system consists of the fact that it is smaller and cheaper.

Double membrane condensor microphones with electrically adjustable pick-up characteristics are already known from literature (e.g. "Taschenbuch der technischen Akustik", Springer Verlag, 1975). These concern, however, "normal" condensor microphones with an external, adjustable and switchable polarization voltage. Such a circuit could not be realized with the "electret" microphones used in the hearing aids, as the level and the polarity of the bias voltage cannot be externally influenced in these microphones.

I claim:

1. A hearing aid for persons with an impaired having faculty comprising:

a directional microphone system with pick-up characteristics that are continuously and electrically variable, said microphone includes:

i. an inverter having an input and an output;

ii. a current-controlled attenuator controlled by said input of said inverter and connected to said inverter output;

iii. two omni-directional electret microphones each having an input opening for receiving the sound to be heard and for producing an output signal in response to the sound, the input openings being spaced apart from each other, and wherein one microphone output is connected to said inverter so that its output voltage is inverted and attenuated; and iv. means for adding the other microphone output voltage with the inverted and attenuated voltage to produce an output signal of the hearing aid having automatically changeable characteristics.

2. The hearing aid as claimed in claim 1, additionally including a housing in which said two omni-directional electret microphones are located.

3. The hearing aid as claimed in claim 1, additionally including means for attenuating the sound to be heard located within one of the input openings, for varying the pickup characteristics of said microphone.

4. The hearing aid as claimed in claim 1, additionally including means for delaying the sound to be heard located in one of the input openings, for varying the pick-up characteristics of said microphone.

5. A hearing aid for persons with an impaired hearing faculty comprising:

a directional microphone system with pick-up characteristics that are continuously and electrically variable, said microphone includes:

i. an inverter having an input and output;

ii. a current-controlled attenuator controlled by an output signal of the hearing aid and connected to said inverter output;

iii. two omni-directional electret microphones each having an input opening for receiving the sound to be heard and for producing an output signal in response to the sound, the input openings being spaced apart from each other, and wherein one microphone output is connected to said inverter so that its output voltage is inverted and attenuated; and iv. means for adding the other microphone output voltage with the inverted and attenuated voltage to produce an output signal of the hearing aid having automatically changeable characteristics.

6. A hearing aid for persons with an impaired hearing faculty comprising:

a directional microphone system with pick-up characteristics that are continuously and electrically variable, said microphone includes:

i. an inverter having an input and an output;

ii. a voltage-controlled attenuator controlled by said input of said inverter and connected to said inverter output;

iii. two omni-directional electret microphones each having an input opening for receiving the sound to be heard and for producing an output signal in response to the sound, the input openings being spaced apart from each other, and wherein one microphone output is connected to said inverter so that its output voltage is inverted and attenuated; and iv. means for adding the other microphone output voltage with the inverted and attenuated voltage to produce an output signal of the hearing aid having automatically changeable characteristics.

7. A hearing aid for persons with an impaired hearing faculty comprising:

a directional microphone system with pick-up characteristics that are continuously and electrically variable, said microphone includes:

i. an inverter having an input and an output;

ii. a voltage-controlled attenuator controlled by an output signal of the hearing aid and connected to said inverter output;

iii. two omni-directional electret microphones each having an input opening for receiving the sound to be heard and for producing an output signal in response to the sound, the input openings being spaced apart from each other, and wherein one microphone output is connected to said inverter so that its output voltage is inverted and attenuated; and iv. means for adding the other microphone output voltage with the inverted and attenuated voltage to produce an output signal of the hearing aid having automatically changeable characteristics.

* * * * *